US005133393A

United States Patent [19]

McGinnis

[11] Patent Number: 5,133,393

[45] Date of Patent: Jul. 28, 1992

[54] WATER DISPENSING SYSTEM

[75] Inventor: John F. McGinnis, Mound, Minn.

[73] Assignee: Pure Drinking Water Systems, Inc., Mound, Minn.

[21] Appl. No.: 584,297

[22] Filed: Sep. 18, 1990

[51] Int. Cl.[5] ..... B65B 43/42; B65B 3/04

[52] U.S. Cl. ..... 141/372; 141/21; 248/297.2

[58] Field of Search ..... 141/369-374, 141/311 R, 312, 165, 166, 177, 269, 227, 228, 378, 18, 21; 248/297.2; 211/79; 312/306

[56] References Cited

U.S. PATENT DOCUMENTS

| | | | |
|---|---|---|---|
| D. 303,497 | 9/1989 | Larson | D9/370 |
| D. 307,389 | 4/1990 | Larson | D9/370 |
| 548,123 | 10/1895 | Hagins | 141/370 X |
| 582,285 | 5/1897 | Henes et al. | 141/372 |
| 1,152,948 | 9/1915 | Hetrick | 248/297.2 X |
| 1,242,313 | 10/1917 | Beals | 141/227 |
| 1,576,214 | 3/1926 | Paskal | 141/372 |
| 2,309,246 | 1/1943 | Henry | 141/369 |
| 2,321,844 | 6/1943 | Nicholson | 141/370 |
| 3,048,206 | 8/1962 | Keller et al. | 141/371 |
| 3,250,303 | 5/1966 | Sollmann | 141/372 |
| 3,447,281 | 6/1969 | Buford et al. | 141/372 |
| 3,856,059 | 12/1974 | Hartness et al. | 141/165 |
| 3,916,963 | 11/1975 | McIntosh | 141/198 |
| 4,126,163 | 11/1978 | Hartness et al. | 141/371 |
| 4,164,964 | 8/1979 | Daniels | 141/329 |
| 4,469,150 | 9/1984 | Grimaldi | 141/95 |
| 4,498,508 | 2/1985 | Scholle et al. | 141/372 |
| 4,712,591 | 12/1987 | McCann et al. | 141/88 |
| 4,721,138 | 1/1988 | Simonazzi | 141/372 |

FOREIGN PATENT DOCUMENTS

| | | | |
|---|---|---|---|
| 1482615 | 4/1970 | Fed. Rep. of Germany | 141/165 |
| 2029197 | 3/1980 | United Kingdom | 248/297.2 |

*Primary Examiner*—Henry J. Recla
*Assistant Examiner*—Casey Jacyna
*Attorney, Agent, or Firm*—Burd, Bartz & Gutenkauf

[57] ABSTRACT

A water dispensing apparatus has a locator for retaining a container in vertical alignment with a discharge tube to allow water to be directed into the container. The locator has a movable carriage which is vertically guided by an upright track. The carriage is moved to actuate a switch and allow a second manually operated switch to be actuated to commence the water dispensing cycle. A solenoid is energized to open a valve whereby water flows from the tube into the container.

26 Claims, 3 Drawing Sheets

WATER DISPENSING SYSTEM

FIELD OF THE INVENTION

This invention relates to dispensers operable to center and fill open top containers of variable dimensions with fluid, particularly to dispensers that are switch actuated to commence the dispensing of liquid.

BACKGROUND OF THE INVENTION

The popularity of bottled drinking water has increased in the past several years. Water is commonly sold retail pre-packaged in bottles, containers, jugs and the like. There are costs associated with prior packaging, handling and storage of water-filled containers. These costs are generally passed onto the consumer.

Prior dispensers have been used to dispense beverages for retail sale in convenience stores that are manually operated by the customer to commence the liquid dispensing cycle. The customer may bring his or her own container to be filled with liquid from the dispenser. For example, P. A. Grimaldi, in U.S. Pat. No. 4,469,150, discloses a dispenser for dispensing liquid into take-away containers. The dispenser has a mobile spout which, when it is in its lower position, is an open contact switch. When the spout is raised, a button can be depressed to being the filling cycle. Additional liquid dispensers having centering apparatus and switch actuated elements are shown by C. H. Sollmann in U.S. Pat. No. 3,250,303; T. P. Hartness, R. G. Hartness and T. S. Hartness in U.S. Pat. No. 3,856,059; and P. J. Daniels in U.S. Pat. No. 4,164,964.

SUMMARY OF THE INVENTION

The invention comprises a water dispenser for filling an open top container with water, such as a bottle, that has a bottle locator with oppositely curved middle sections adapted to align the open end of the container with a water discharge tube. Upward movement of the locator along an upright track actuates a first switch so that a second switch can be manually operated to commence the water dispensing cycle. The oppositely curved middle sections engage the top of the container to automatically align the open end of the container with the water discharge end of the tube. This decreases the effort and time required to properly position the container in the dispenser prior to filling. The dual switch operated dispenser prevents accidental discharge of water from the tube.

The dispenser has a box-shaped housing having a top wall, bottom wall joined to side and back walls to define an inner chamber for accommodating a container. A tube extends downwardly from the top wall of the housing into the chamber. A generally upright track secured to the back wall movably mounts a bottle locator on the housing. The bottle locator is adapted to retain the top of the container in general vertical alignment with the water discharge passage of the tube so that water is directed into the container. The locator has a pair of outwardly directed rods having U-shaped portions located in general vertical alignment with opposite sides of the tube. The U-shaped portions curve outwardly relative to each other defining an opening which is located in vertical alignment with the passage. The inner ends of the rods are secured to a carriage that is slidably mounted on the track whereby the carriage and rods can move between up and down positions. A plurality of rollers rotatably mounted on the carriage are accommodated by channels on the opposite upright sides of the track. A first normally closed switch is mounted on the back wall adjacent the track. The first switch has an actuator that extends into one of the channels. One of the rollers is engageable with the actuator to hold the first switch in the open position when the carriage and locator are in the down position. The first switch moves to the closed position when the roller is moved out of engagement with the actuator. A second manually operated switch mounted on the housing is operable to commence the dispensing of water from the tube when the first switch is in the closed position. A solenoid operated valve is used to control the flow of water through the tube. The solenoid of the valve is energized when both switches are closed. The dispenser includes a filter operable to filter the water discharged from the tube and a gallon counter to measure the quantity of water dispensed from the tube.

DESCRIPTION OF THE PREFERRED EMBODIMENT

Figure 1:
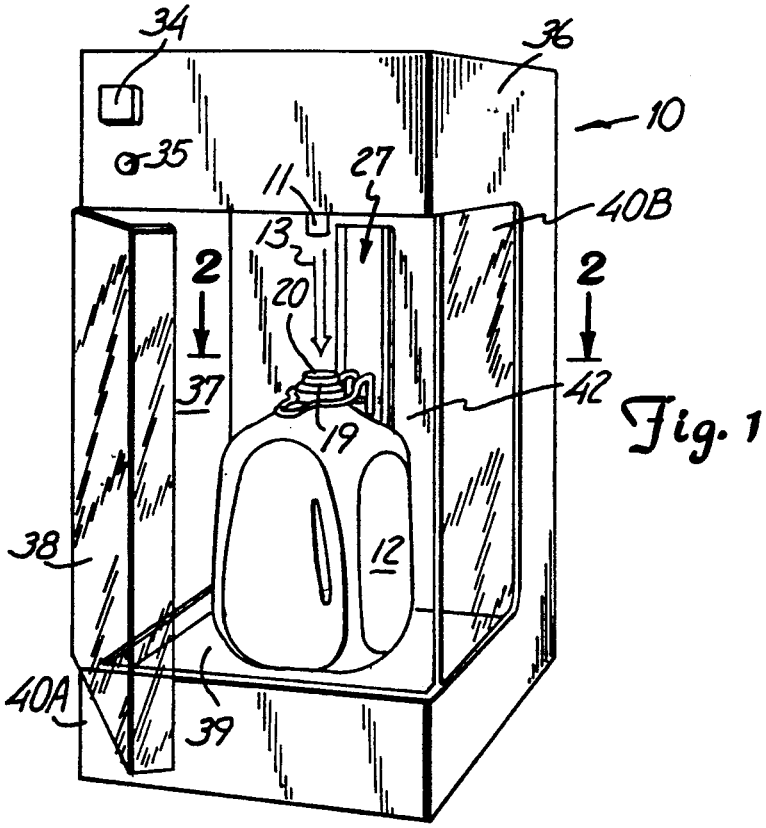
FIG. 1 is a perspective view of the water dispenser of the invention and a bottle positioned thereon for receiving water.

Referring to FIG. 1, there is shown a water dispenser of the invention indicated generally at 10 usable to fill a container or bottle 12 with water or other liquid. Examples of bottles having top openings usable with dispenser 10 are shown in U.S. Pat. Nos. Des. 303,497 and Des. 307,389. Other bottles having top openings can be used with dispenser 10 to accommodate water or other liquids. Dispenser 10 is operable to automatically position and retain bottle 12 in vertical alignment with a water discharge tube 11 during the filling of the bottle with water. Dispenser 10 can be used to fill containers having various sizes and shapes. Supermarkets and convenience stores can use dispenser 10 to commercially sell bulk drinking water.

Figure 6:
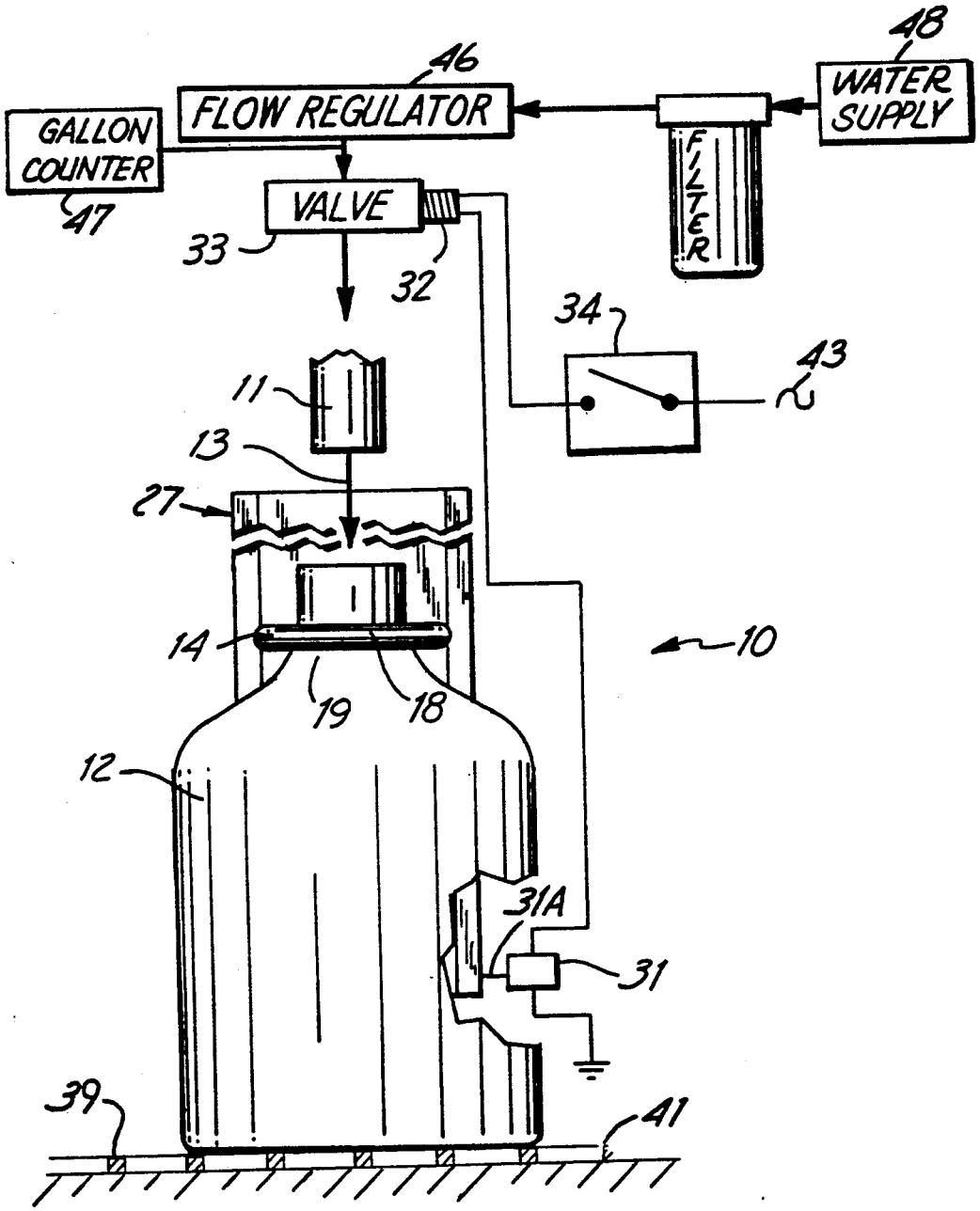
FIG. 6 is a diagrammatic view of the water dispenser of FIG. 1.

Water dispenser 10 has a box-shaped cabinet or housing 36 having an internal chamber 37 for accommodating a water container or bottle 12. Bottle 12 is a generally rectangular shaped one-gallon capacity plastic jug having an inwardly tapered shoulder terminating in an upwardly directed tubular neck 19 having a generally circular open end 20. Bottle 12 may have other sizes and shapes, such as the bottles shown in U.S. Pat. Nos. Des. 303,497 and Des. 307,389. A door 38 pivoted on a side wall 40A of housing 36 is used to enclose bottle 12 within housing 36. Door 38 and side walls 40A and 40B of housing 36 are preferably made of transparent material so that the contents of chamber 37 can be visually inspected. Housing 36 has a generally flat floor 39 that supports bottle 12. Floor 39 has a plurality of drain holes or slots 41 to allow excess water to drain from housing 36, as shown in FIG. 6. A water discharge tube 11 extends into chamber 37 from the top portion of housing 36. Tube 11 is used to direct water in a downward direction into the open top 20 of bottle 12, as indicated by arrow 13 in FIGS. 1 and 6. Tube 11 is generally centrally located on the bottom face of the top portion of housing 36.

Figure 2:
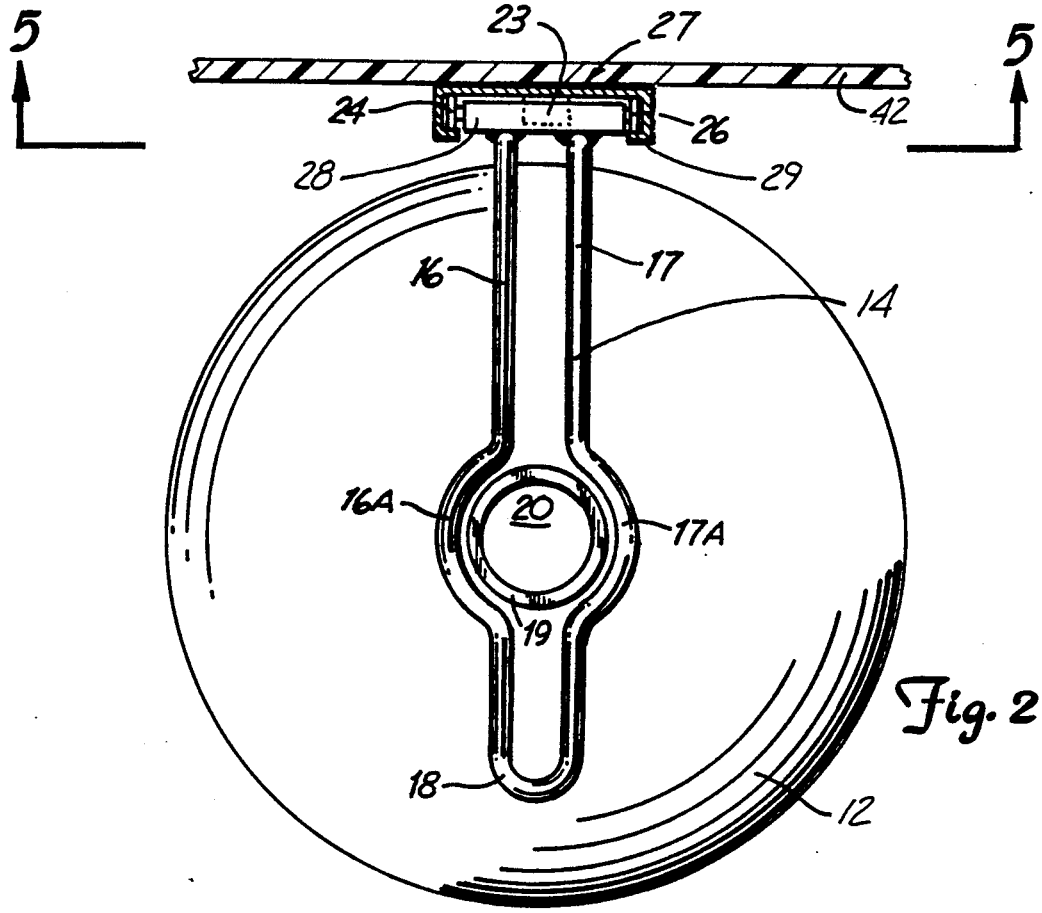
FIG. 2 is an enlarged sectional view taken along line 2—2 of FIG. 1.

Bottle 12 is supported on floor 39 in vertical alignment with discharge tube 11 with a bottle positioner or locator 14. As seen in FIG. 2, locator 14 has a pair of laterally spaced rods 16 and 17 that extend outwardly from the back wall 42 of housing 36. Rods 16 and 17 terminate in an outwardly directed handle 18 which facilitates operation of locator 14. The middle sections of rods 16 and 17 have outwardly curved or U-shaped portions 16A and 17A that are located in general vertical alignment with opposite sides of discharge tube 11. Curved portions 16A and 17A have outwardly arcuate shapes concentrically aligned with the longitudinal or water flow axis of water discharge tube 11. U-shaped sections 16A and 17A are adapted to embrace opposite curved portions of neck 19 of bottle 12. The U-shaped sections 16A and 17A can embrace bottle necks having different sizes and shapes while maintaining the vertical concentric alignment of the open end of the bottles with water discharge tube 11. Neck 19 extends through the generally circular opening between U-shaped sections 16A and 17A whereby the position of bottle 12 on floor 39 is fixed and the open end 20 of bottle 12 is in vertical alignment with the passage of tube 11. The lateral distance between the inner and outer portions of rods 16 and 17 is substantially less than the diameter of the circular space between U-shaped sections 16A and 17A to prevent neck 19 from being inserted between the inner and outer portions of rods 16 and 17.

Upon operation of dispenser 10 water can then be discharged from tube 11 into bottle 12. Bottle locator 14 eliminates the need for the operator to manually center the open end 20 with tube 11 before filling bottle 12 with water. The operator simply has to position the bottle on floor 39 so that neck 19 extends through the circular opening between U-shaped sections 16A and 17A to automatically align the passage of tube 11 with the open end 20 of bottle 12.

Figure 5:
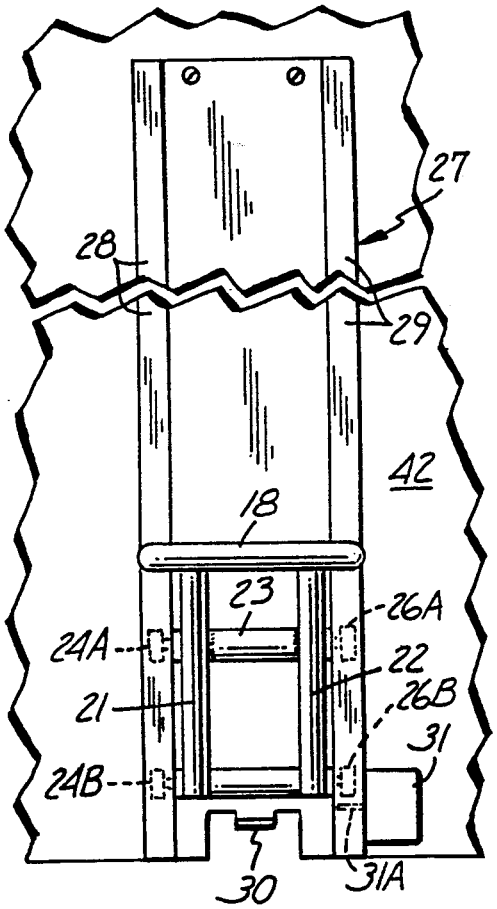
FIG. 5 is an enlarged sectional view taken along line 5—5 of FIG. 2 showing the bottle locator in the bottle holding position.

Referring to FIG. 5, the inner ends of rods 16 and 17 are turned downwardly into downwardly directed laterally spaced legs 21 and 22. Legs 21 and 22 are secured to the front face of a carriage 23 with welds or the like. Carriage 23 comprises a pair of horizontal rods extended between upright channels 28 and 29. Two pairs of rollers 24A, 24B and 26A, 26B are rotatably mounted on opposite ends of the rods of carriage 23. Rollers 24A, 24B and 26A, 26B ride in generally U-shaped upright channels 28 and 29 on opposite upright sides of an upright elongated track 27. Track 27 is secured with fasteners to the front face of back wall 42 of housing 36. Track 27 guides carriage 23 and locator 14 along a generally vertical plane. Handle 18 can be gripped and locator 14 can be raised to an up position on track 27 allowing bottle 12 to be placed on floor 39 below tube 11. When bottle 12 is placed on floor 39, locator 14 can then be lowered onto the top of the bottle. The weight of locator 14 and carriage 23 retains bottle 12 on floor 39. Bottle 12 is positioned so that neck 19 extends through the opening between U-shaped sections 16A and 17A. U-shaped sections 16A and 17A engage opposite sides of neck 19 and vertically align the open end 20 of bottle 12 with the passage of tube 11.

Figure 3:
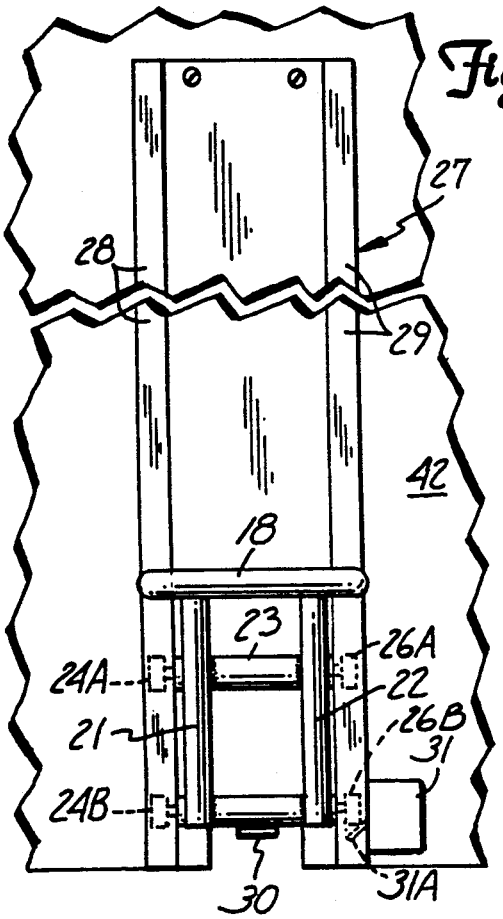
FIG. 3 is a front elevational view of the bottle locator positioned in the down position.
Figure 4:
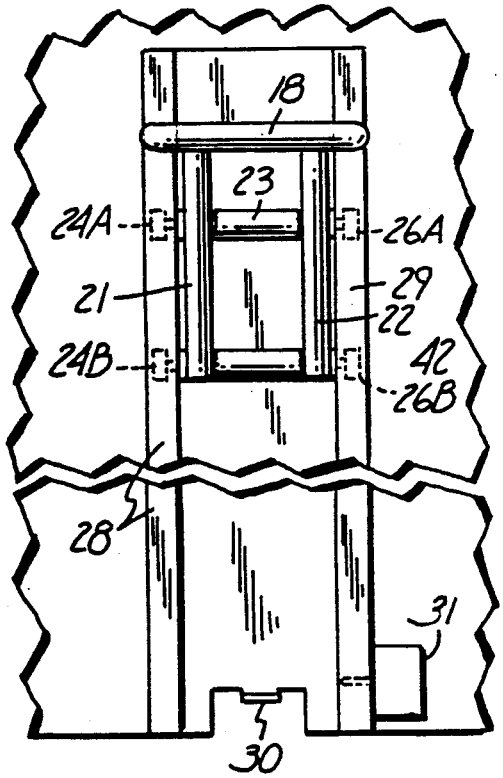
FIG. 4 is a front elevational view of the bottle locator positioned in the up position.

Referring to FIGS. 3, 4 and 6, a normally closed switch 31 is located adjacent to the lower portion of track 27 adjacent lip. 30. Lip 30 functions as a stop that limits the downward travel of carriage 23 along track 27. Switch 31 has an actuator 31A that is biased to a closed position. When carriage 23 is in a down position adjacent the lower end of track 27 in engagement with lip 30, roller 26B engages actuator 31A to hold switch 31 in the open position, as shown in FIG. 3. When carriage 23 is moved upwardly along track 27, roller 26B moves out of engagement with actuator 31A allowing the actuator 31A to move to the closed position thereby closing switch 31. Switch 31 will remain closed as long as carriage 23 is in the upper position, as shown in FIGS. 4 and 5. As seen in FIG. 6, switch 31 is electrically connected to a solenoid 32. The solenoid 32 is connected to a valve 33 which is operable to control the flow of water into tube 11. A manually operated push button switch 34 connects a source of electric power 43 to solenoid 32. When push button 34 is closed and switch 31 is closed, solenoid 32 is energized thereby opening valve 33 to commence the dispensing of water from tube 11.

Referring to FIG. 6, water is supplied from water supply 48 to valve 33 through a filter 44 and flow regulator 46. Additional filters (not shown) may be used in the supply of water to valve 33. A gallon counter 47 is also located in the water line enabling dispenser 10 to count the number of gallons of water that are dispensed into bottle 12. Dispenser 10 has a light 35 that is turned on to indicate that the dispenser is out of service, as shown in FIG. 1.

In use, a consumer desiring to fill a bottle 12 with drinking water opens door 38 of housing 36 and grips handle 18. Locator 14 and carriage 23 are then moved upwardly along track 27 to the up position shown in FIG. 4 to allow bottle 12 to be placed on floor 39 below tube 11. Rollers 24A, 24B and 26A, 26B ride in channels 28 and 29 enabling locator 14 and carriage 23 to move in an upward direction. After bottle 12 is positioned generally below the opening between U-shaped sections 16A and 17A, locator 14 is then lowered into engagement with neck 19 of the bottle. U-shaped sections 16A and 17A of rods 16 and 17 embrace opposite curved portions of bottle neck 19 to fix the position of bottle 12 on floor 39 and place the open end 20 in vertical alignment with the passage of discharge tube 11. The weight of locator 14 and carriage 23 retains bottle 12 in an upright position on floor 39. If preferred, door 38 is then closed to enclose bottle 12 within housing chamber 37.

When carriage 23 is moved upwardly along track 27, roller 26B moves out of engagement with actuator 31A and switch 31 closes. Push button 34 is manually operated to close switch 34. This connects electric power source 43 to solenoid 32 whereby the solenoid is energized causing valve 33 to open and water to be dispensed from tube 11 into the open end 20 of bottle 12. In the event of over flow, water can drain out of housing 36 through drain holes 41 in floor 39. Water moves through filter 44 to remove undesirable chemicals and particles from the water discharged from tube 11. Gallon counter 47 located in the water line counts the quantity of water dispensed from tube 11. Light 35 is energized to indicate that dispenser 10 is temporarily out of order.

When filling of bottle 12 is complete, switch 34 is deactivated to shut off solenoid 32 and close valve 33. Door 38 is opened and locator 14 is raised so that bottle 12 can be removed from housing 36. After bottle 12 is removed from housing 36, locator 14 and carriage 23 can move to the down position in engagement with lip 30 adjacent the lower portion of track 27 whereby roller 26B engages actuator 31A to hold the switch 31 in the open position. When switch 31 is in the open position, dispenser 10 cannot be operated even if push button 34 is actuated. This prevents inadvertent dispensing of water from tube 11.

Containers and bottles having differing heights and circumferences can be filled with water using water dispenser 10. Locator 14 is operable to automatically vertically align the open end 20 of bottle 12 with discharge tube 11 with a minimum of effort. Switches 31 and 34 cooperate to prevent inadvertent dispensing of water from dispenser 10.

While there has been shown and described a preferred embodiment of the water dispenser, it is understood that changes in materials, size, shape, and arrangement of structure may be made by those skilled in the art without departing from the invention. The invention is defined in the following claims.

I claim:

1. A dispenser for discharging liquid into a container having a top opening comprising: a housing, container locator means mounted on the housing, tube means mounted on the housing adjacent the container locator means, the container locator means having a pair of outwardly directed members including U-shaped portions located in general vertical concentric alignment with opposite sides of the tube means, each member having an inner end, adapted to retain the top opening of a container in general vertical alignment with the tube means to allow liquid to flow from the tube means into the container, means movably mounting the container locator means on the housing allowing the container locator means to move from a down position to an up position relative to the housing, the means movably mounting the container locator means on the housing includes support means secured to the inner ends, a plurality of rollers rotatably mounted on the support means, and a generally upright track secured to the housing, the track having opposite upright sides with channels accommodating the rollers, and switch means actuated by movement of the container locator means from an open position to a closed position whereby when the container locator means is moved from the down position to the up position, the switch means moves from its open position to a closed position to allow liquid to be dispensed from the tube means into the top opening of the container, the switch means has an actuator extending into one of the channels, one of the rollers engageable with the actuator to hold the switch means in the open position when the container locator means is in the down position.

2. The dispenser of claim 1 wherein: the tube means has a passage, the U-shaped portions curve outwardly relative to each other defining an opening, the opening located in vertical alignment with the passage.

3. The dispenser of claim 1 including: manually operated second switch means mounted on the housing operable to commence the dispensing of liquid from the tube means when the first switch means is in the closed position.

4. The dispenser of claim 3 wherein: the first switch means is a normally closed switch, the first switch being in the closed position when the container locator means is in the up position.

5. The dispenser of claim 1 wherein: the housing is a generally rectangular box having side walls and a back wall joined to top and a bottom wall defining an inner chamber, the tube means extending downwardly relative to the top wall toward the chamber, said generally upright track being secured to the back wall.

6. The dispenser of claim 5 wherein: the bottom wall has a plurality of holes to allow excess liquid to drain from the housing.

7. A dispenser for discharging liquid into a container having a top opening comprising: a housing, container locator means mounted on the housing, tube means mounted on the housing adjacent the container locator means, the container locator means having means adapted to retain the top opening of a container in general vertical alignment with the tube means to allow liquid to flow from the tube means into the container, means movably mounting the container locator means on the housing allowing the container locator means to move from a down position to an up position relative to the housing, and switch means actuated by movement of the container locator means from an open position to a closed position whereby when the container locator means is moved from the down position to the up position, the switch means moves from its open position to the closed position to allow liquid to be dispensed from the tube means into the top opening of the container, the housing is a generally rectangular box having side walls and a back wall joined to top and bottom walls defining an inner chamber, the tube means extending downwardly relative to the top wall toward the chamber, the means movably mounting the container locator means on the housing including a generally upright track secured to the back wall, and support means movably mounted on the track, the container locator means having inner ends secured to the support means whereby the track guides the support means and container locator means between the up and down positions, the track has opposite upright sides with channels, the channels accommodating the rollers rotatably mounted on the support means, the switch means including an actuator extending into one of the channels, one of the rollers engageable with the actuator to hold the switch means in the open position when the container locator means is in the down position.

8. The dispenser of claim 7 wherein: the switch means is a normally closed switch, the switch moving to the closed position when the roller is moved out of engagement with the actuator.

9. The dispenser of claim 8 including: a manually operated second switch means mounted on the housing operable to commence the dispensing of liquid from the tube means when the first switch is in the closed position.

10. A water dispenser for filling a container having an open top with water comprising: a housing having a top wall, bottom wall joined to side walls and a back wall defining an inner chamber for accommodating a container, tube means mounted on the top wall extended into the chamber, the tube means having a passage, container locator means mounted on the back wall adapted to retain the open top of the container in vertical alignment with the passage, carriage means secured to the container locator means, track means mounted on the back wall accommodating the carriage means, the carriage means movably mounted on the track means to allow the container locator means to move from a down position to an up position relative to the back wall, first switch means mounted on the back wall adjacent the track means, the carriage means engageable with the first switch means to hold the first switch means in an open position, the first switch means moving to a closed position when the carriage means is moved out of engagement with the first switch means, electric operated control means to control the flow of water through the tube means, and second switch means operable to connect a source of electric power to the control means whereby when the first switch means is in the closed position and the second switch means is actuated, the control means is operated to commence the dispensing of water from the tube means.

11. The dispenser of claim 10 wherein: the container locator means comprises a pair of rods, each rod having an outwardly curved middle section adapted to engage opposite sides of a top portion of the container adjacent the open end, the middle sections located in general vertical alignment with opposite sides of the tube means.

12. The dispenser of claim 11 wherein: the rods having outer ends terminating into a handle located outwardly from the middle sections.

13. The dispenser of claim 10 wherein: the carriage means comprises support rods having opposite ends, a plurality of rollers rotatably mounted on opposite ends of the support rods, the track means comprising a generally upright track, the track having upright sides with U-shaped channels for accommodating the rollers.

14. The dispenser of claim 13 wherein: the first switch means includes an actuator that extends into one of the channels, one of the rollers engageable with the actuator to hold the first switch means in the open position when the container locator means is in the down position.

15. The dispenser of claim 14 wherein: the first switch means is a normally closed switch, the switch moving to the closed position when the roller is moved out of engagement with the actuator.

16. The dispenser of claim 10 wherein: the second switch means comprises a manually operated switch, the control means comprising a solenoid operated valve.

17. The dispenser of claim 16 including: means operable to filter water discharged from the tube means.

18. The dispenser of claim 10 including: means to measure the quantity of water dispensed from the tube means.

19. A dispenser for discharging liquid into a container having a top opening comprising: a housing, container locator means mounted on the housing, liquid discharge means mounted on the housing adjacent the container locator means, the container locator means having means adapted to retain the top opening of a container in general vertical alignment with the liquid discharge means to allow liquid to flow from the liquid discharge means into the container, upright track means mounted on the housing, carriage means connected to the container locator means movably mounted on the track means to allow the container locator means to move from a down position to an up position relative to the housing, a normally closed switch means having an actuator engagable by the carriage means to hold the switch means in its open position to prevent dispensing off liquid when the container locator means is in the down position, said switch means moves from an open position to a closed position when the carriage means moves away from the actuator to allow liquid to be dispensed from the liquid discharge means into the top opening of the container.

20. The dispenser of claim 19 wherein: the container locator means comprises a pair of outwardly directed rods, the means adapted to retain the top opening of a container in alignment with the liquid discharge means comprising U-shaped portions of the rods located in general vertical concentric alignment with opposite sides of the liquid discharge means.

21. The dispenser of claim 20 wherein: the tube means has a passage, the U-shaped portions curve outwardly relative to each other defining an opening, the opening located in vertical alignment with the passage.

22. The dispenser of claim 20 wherein: each member has an inner end secured to the carriage means, a plurality of rollers rotatably mounted on the carriage means, and the track means having opposite upright sides with channels accommodating the rollers.

23. The dispenser of claim 19 wherein: the housing is a generally rectangular box having side walls and a back wall joined to top and bottom walls defining an inner chamber, the liquid discharge means extending downwardly from the top wall into the chamber, the generally upright track being secured to the back wall, the container locator means having inner ends secured to the carriage means whereby the track guides the carriage means and container locator means between the up and down positions.

24. The dispenser of claim 23 wherein: the container locator means comprises a pair of rods extending outwardly from the carriage means, the means adapted to retain the top opening of a container in alignment with the liquid discharge means comprising U-shaped portions of the rods located in general vertical concentric alignment with opposite sides of the liquid discharge means.

25. The dispenser of claim 24 wherein: the liquid discharge means has a passage, the U-shaped portions curve outwardly relative to each other defining an opening for accommodating a top portion of the container, the opening located in vertical alignment with the passage whereby when the top portion extends through the opening, the top opening of the container is in vertical alignment with the passage.

26. The dispenser of claim 23 wherein: the bottom wall has a plurality of holes to allow excess liquid to drain from the housing.

* * * * *